US005709120A

United States Patent [19]

Shilling

[11] Patent Number: 5,709,120

[45] Date of Patent: Jan. 20, 1998

[54] STRAIGHT LINE DRAWING DEVICE

[76] Inventor: Paul L. Shilling, 309 S. Folcroft St., Baltimore, Md. 21224

[21] Appl. No.: 604,803

[22] Filed: Feb. 23, 1996

[51] Int. Cl.[6] ..... B21C 1/28

[52] U.S. Cl. ..... 72/290; 294/115

[58] Field of Search ..... 72/290; 294/115, 294/106, 82.32

[56] References Cited

U.S. PATENT DOCUMENTS

| | | | |
|---|---|---|---|
| 327,575 | 10/1885 | Mitchell | 294/115 |
| 967,178 | 8/1910 | Edison | 72/290 |
| 1,220,899 | 3/1917 | Sorensen | 294/115 |
| 1,498,251 | 6/1924 | Trailor | 294/115 |
| 2,358,632 | 9/1944 | Gerken | 294/115 |
| 3,451,711 | 6/1969 | Carpenter | 294/115 |

FOREIGN PATENT DOCUMENTS

| | | | |
|---|---|---|---|
| 970486 | 9/1958 | Germany | 294/106 |
| 1418262 | 8/1988 | U.S.S.R. | 294/115 |
| 16215 | 10/1889 | United Kingdom | 72/291 |

*Primary Examiner*—Daniel C. Crane
*Attorney, Agent, or Firm*—Peter Gibson

[57] ABSTRACT

A drawing device which may be vertically or horizontally disposed in operation has a single rigid formed or extruded length as a bed. To one end of the bed is affixed a manual winch using a belt for applying tension to the workpiece. The belt is affixed to the upper end of a draw block with a lower end pivoted to two inverted lateral link arms each extending outward with an incline upwards to one distal end of the two straight, non-crossing jaw arms. The tension applied to the draw block is translated by the inverted lateral link arms into force directed outward upon the distal ends of the jaw arms which closes the jaws. The mechanical leverage obtained allows a reduction in overall length and weight of the draw tongs. Between the draw block and a stop bracket to which the jaws are pivoted, a stop bolt extends with a spring about it in compression biasing the jaws shut and facilitating manual loading of the workpiece. With the draw tension directed upwards the stop bolt is disposed head down with the shaft extending through a bore trapping the head in the stop bracket and threading into the lower end of the draw block. This provides an adjustable positive stop. The draw plate or die is held by a spring clip formed from a slotted steel shim attached at one side to and spaced apart from a stanchion attached to the end of the bed distal the winch.

11 Claims, 3 Drawing Sheets

FIG 1 PRIOR ART
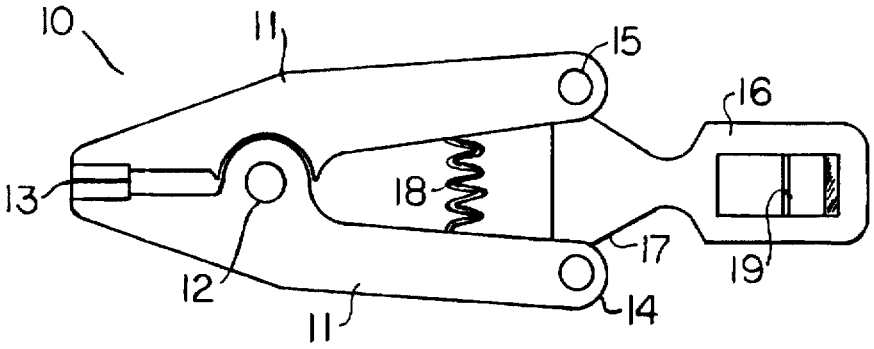
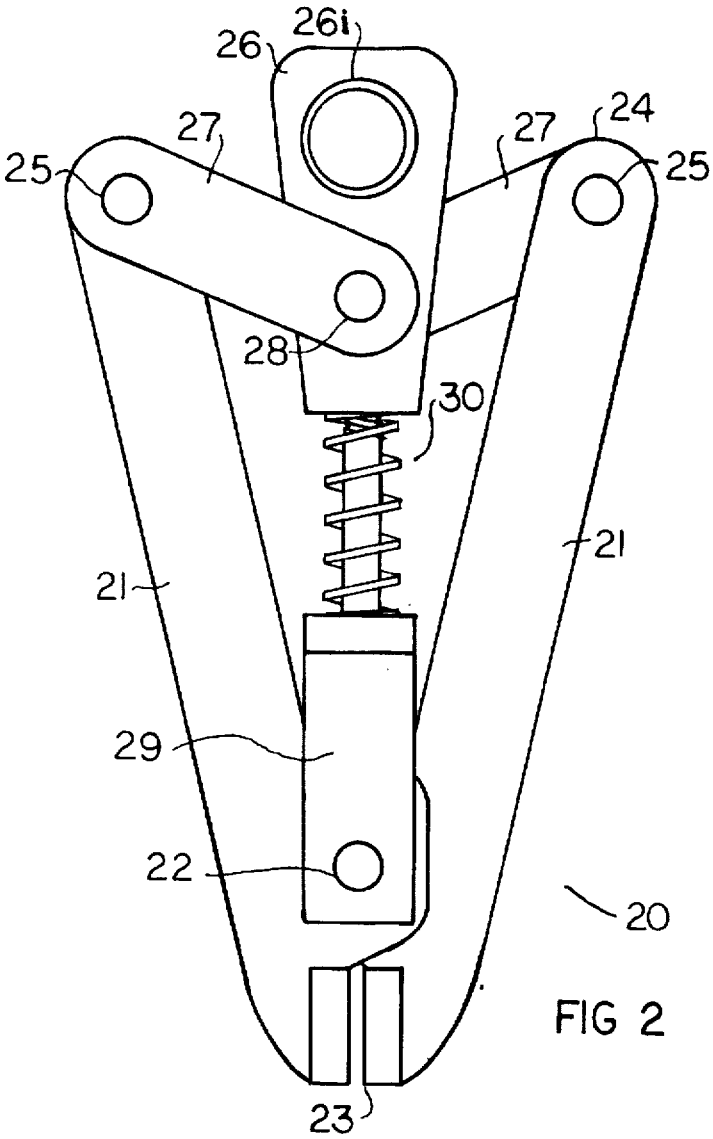
FIG 2

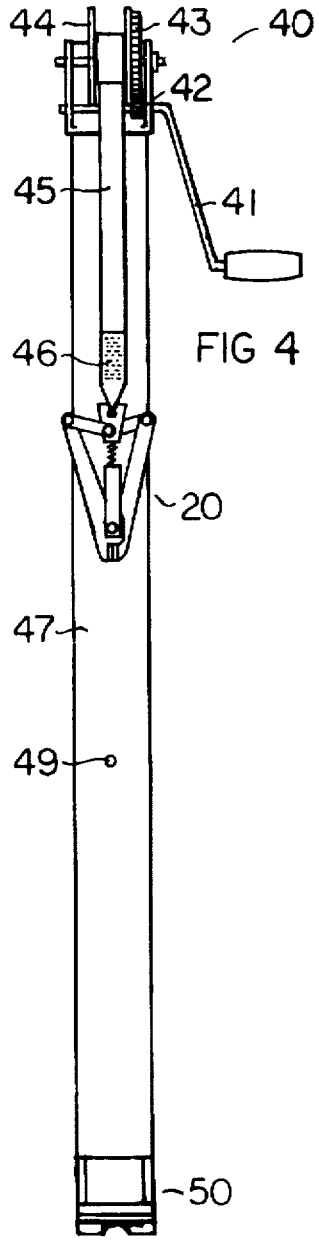
FIG 4
FIG 5
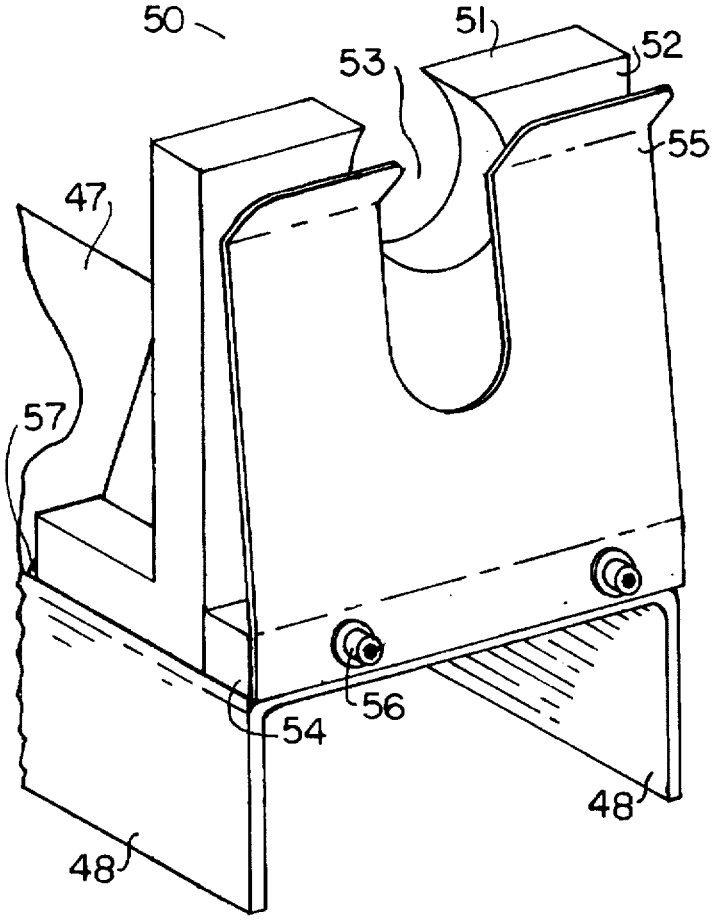

STRAIGHT LINE DRAWING DEVICE

BACKGROUND OF THE INVENTION

1. Field of the Invention

The field of the present invention relates generally to 'metal deforming' (Class 72) 'by pulling workpiece through closed periphery die' (subclass 274), ie. drawing; more particularly to drawing by 'utilizing specified work moving means' (subclass 287). ie. draw tongs; most specifically for 'maintaining a 'straight-line-draw' (subclass 291), and especially for the craftsman as opposed to large scale production.

2. General Background

The drawing of wire with a comparatively small scale device affordable by the craftsman is dominated by horizontal benches which utilize a chain to tension a draw block connected to the draw tongs which grip the workpiece. Both draw tongs with crossed jaws at the pivot between the jaws that squeeze to close, and straight jaw tongs, with each jaw acting along one side of the pivot that squeeze to open, are utilized. The crossed jaw tongs grip the workpiece with inward displacement of the distal ends of the jaw arms, the straight jaws grip with outward displacement of the same. Opening crossed jaw tongs requires moving the jaw arms apart which, in a manual operation, is inherently awkward in comparison with grasping straight jaw arms spring biased shut with one hand while the other inserts the workpiece.

Specific types of straight jaw draw tongs and the associated attributes are discussed in the context of particular references below. With regard to the other general aspects of drawing machines or devices suited to the craftsman, it is noted that the tension effecting the draw is either created manually with a crank or an electric motor and is typically transmitted to the draw tongs via a chain, though other methods are known, as discussed below. Lastly it is noted that of all the various devices known for straight line drawing by the craftsman a horizontal draft is employed in all cases.

DISCUSSION OF THE PRIOR ART

U.S. Pat. No. 577,095 for a 'Dog or Gripper for Use on Draw Benches' discloses a pair of straight jaw tongs closed by the tension applied to a central wedge acting upon the jaw arms without provision for a spring to bias the jaws shut. Cavallin, an Italian company, currently manufactures and sells similar straight jaw draw tongs which are further biased shut with a spring in compression between the jaw arms, advertised as "positive-grip jaws". Conventional draw benches, such as those made and sold by Cavallin, apply tension with a chain which is transferred by a wedge trapped by and acting upon roller pins set in the distal ends of the jaw arms. Manual crank draw benches available from Cavallin range from about $800 to about $1,300, and this product line is considered to represent well the standard, conventional devices developed for the craftsman. One typical model of Cavallin draw tongs, with an overall length of nine and a half inches, currently costs about $145 in the U.S.

Opposed to this well known conventional drawing equipment there is a recent product advertised as a 'Quick Draw Wire-Forming Machine' associated with U.S. Pat. No. 115, 255,551. The advertised product employs a Black & Decker™ hand held power drill to drive, through a flexible coupling, a lead screw which is horizontally disposed between two guide rods between stanchions mounted in opposition each proximate an end of a board. The 'work moving means' consists of a block, tapped for the lead screw and bored for the rods, with a pair of Vise Grips™ mounted thereon. A clamp biased against the nether face of the stanchion opposite the drill is comprised of a simple steel sheet with a circular aperture towards the top edge which is flanged outward from the stanchion. This product currently sells for about $275.

With regard to draw tongs utilizing lateral link arms pivoted to the distal ends of the jaw arms, many references are readily found which disclose use of lateral arms extending towards the direction of the tension applied, pivotally connected to the ends of crossing jaw arms. Several examples are found in U.S. Pat. No. 967,178 for a 'Tube Forming Machine, U.S. Pat. No. 1,172,448 for a 'Draw Bench' and U.S. Pat. No. 1,816,484 for 'Drawbench Tongs'.

Another U.S. Pat. No. 293,166 for a 'Metal Drawing Dog', is also considered relevant to the present invention. It discloses a device with lateral link arms which act towards the direction of the tension applied though it does not disclose a pair of draw tongs consistent with the other tongs discussed herein. The dog uses a pair of opposed "biting points" which are slidably adjustable with regard to depth of penetration into the workpiece. Each dog is aligned with a lateral member pivoted both distally to coupling arms which depend from the draw block and proximate the workpiece to a central pair of plates aligned horizontally and each connected to an end of a central yoke which terminates in a threaded shaft extending through a bore in the draw block so that a nut threaded thereon acts as a stop for the force applied in gripping the workpiece. It is noted that this device seems suited to the drawing of relatively large gauge wire and is unsuited to the craftsman. The biting action of the single tooth jaws easily cuts through thinner wires and the numerous adjustments are rather cumbersome to operation.

One more drawing bench known in the prior art reveals an early use of straight jaw style draw tongs: GB 0016215, October 1889, 72-291, AU 321-38910. The draw bench disclosed in this reference illustrates the only known use of inverted lateral arm links operating between the ends of the jaw arms distal the pivot between the two. The links are pivoted centrally to a draw block upon which the tension transmitted via a chain is exerted at a point along the axis of the draw closer to the jaw pivot than the line through the pivots of the link arms with the distal ends of the jaw arms. No further attachments or linkages are disclosed in regard to the operation of the draw tongs other than the simple hook depending from the draw block to which the link arms are centrally pivoted.

The above discussed prior art constitutes that which is considered the most relevant to the present invention. It is observed that the use of inverse lateral link arms, as disclosed in the reference discussed immediately above, obtains mechanical leverage in the transmittal of force in displacement of the distal ends of the straight jaw arms outward, as required for exerting grip by the tongs. It is further observed that if the lateral link arms are pulled in tension to a level wherein the arms are proximate to parallel with each other, perpendicular the axis of the draw, catastrophic failure of the device will likely result.

With regard to the other prior art discussed, it is considered that the cost of conventional style drawing benches, such as those currently offered by Cavallin or Fischer, a German company, is necessarily high given the construction utilized. Conversely, the construction of the drill operated 'Quick Draw Wire Forming Machine' discussed above is considered to be necessarily limited in drawing capacity by the torque available from the electric motor in the hand drill utilized, as well as by the force of the grip available from the gripping device utilized, essentially a pair of clamping pliers. The drawing capacity of this machine is only 3mm in annealed brass, which is compared to a standard drawing capacity of 10mm on a conventional chain driven draw bench such as the models discussed above made by Cavallin.

STATEMENT OF NEED

The distal ends of crossed jaw tongs, which squeeze to close, will eventually meet under excessive load at which point further displacement is prohibited. Conventional, simple, straight jaw draw tongs, which squeeze to open, have no inherent stop against outward displacement of the ends of the jaw arms distal the jaws other than the overall strength of the device in general and the rigidity of the jaw arms in particular. In order to preserve simplicity of design and construction, conventional straight jaw draw tongs, such as those made by Cavallin, are simply made strong enough to avoid flexing under excessive loads. The rigidity required to avoid flexing under excessive loading demands that the construction, whether in machined steel plates or cast steel jaw arms, is of a considerable mass.

Moreover, a conventional horizontal drawing bench utilizing a chain drive acting upon simple straight jaw tongs is necessarily of heavy construction and is consequently expensive in comparison with other drawing machines of comparatively limited drawing capacity. The use of inverted lateral link arms, as discussed above, introduces mechanical leverage into the gripping effected by the draw tongs, but also possesses an inherent potential for catastrophic failure which is unacceptable.

A need therefore is considered to exist for a drawing device including draw tongs which possesses a drawing capacity comparable to conventional horizontal bed, chain driven, drawing benches but which possesses a construction which is inherently less expensive. It is further considered that a need exists for a pair of draw tongs having the mechanical advantage associated with inverse link arms which has no inherent potential for catastrophic failure in operation and might further obtain a load capacity comparable to conventional draw tongs with a shorter overall length and lighter weight.

SUMMARY OF THE INVENTION

OBJECTS OF THE INVENTION

The encompassing objective of the present invention is the provision of a device with a construction which is inherently less costly than conventional chain driven draw benches that enables a straight line draw capacity in force and in length of draw comparable to a conventional draw bench.

A principal objective of the present invention is a drawing device possessing a bed with a manual winch at one end of the bed using a belt to transfer tension to straight jaw draw tongs which pull the workpiece through a closed periphery die held by a die plate holder comprised of a slotted steel shim formed into a clip attached to a stanchion disposed at the other end of the bed.

An auxiliary objective of the present invention is a drawing device which is conveniently operable in a vertical disposition, in addition to being operable in the conventional, horizontal disposition. A vertical disposition locates the manual winch at a convenient height, reduces the floor space required for operation and eliminates the need for legs or other means of disposing a horizontal bench at a convenient height from floor level with adequate stability.

Other auxiliary objectives of the present invention include the provision of a pair of draw tongs which is quickly and easily loaded with the grasp of one hand which possesses a gripping capacity comparable to a conventional pair of simple straight jaw draw tongs with a construction which enables both significantly less mass and length in construction than that required for a conventional pair of straight draw tongs.

Other objectives and advantages to the present invention will become apparent in a reading of the detailed description of the preferred embodiments following a summary of the principles relating to the present invention and brief description of the drawings attached hereto and intended for reference in reading said detailed description.

PRINCIPLES RELATING TO THE PRESENT INVENTION

The use of inverted lateral link arms centrally pivoted to a draw block and distally pivoted to the ends of the jaw arms distal the jaws yields a mechanical advantage in the transmittal of tension applied upon the draw block in forcing the jaw arms outward, closing the jaws, gripping the workpiece. This mechanical advantage enables the draw tongs to have an overall length and weight which is significantly less than conventional straight jaw arm draw tongs. It is further believed that a construction which is inherently less expensive is also enabled thereby. A positive stop which prohibits the lateral link arms from achieving perpendicularity with the draft line is necessary, however, to avoid possible failure under excessive load.

In one preferred embodiment in accordance with the principles relating to the present invention a stop bolt, centrally disposed along the draft line, threads into the bottom end of the draw block oriented with the tension acting upward. The head of the stop bolt is trapped in a stop bracket to which the jaws are pivoted. An adjustable positive stop to further travel of the draw block and the lateral link arms is thus effected. A spring about the shaft of the stop bolt applies compression against the bottom face of the draw block and the upper face of the stop bracket and biases the inverted lateral link arms outward and the jaws shut.

Other means of effecting a positive stop may be utilized. It is only necessary that outward displacement of the distal ends of the jaw arms be restricted in some manner. Either a link between the central pivot and the jaw pivot, as is the case discussed above, or a link between the two pivots between the distal ends of the jaw arms and the lateral link arms, essentially, are suggested for providing a positive stop. A third type of stop comprising a rigid extension of the draw block preventing the lateral link arms from achieving perpendicularity with the draft line is also described.

A bed is comprised of a length of adequately strong and rigid material, preferably steel or extruded aluminum, preferably with a cross section comprising a flat bottom U with sides of lesser width than the middle. To one end of the bed is attached a winch, preferably a winch with a manual crank driving a small gear engaging a large gear rotating a drum with a belt wound upon the same. The belt is preferably of a nylon or other suitably high strength weave or other composition and is attached appropriately to the draw block. At the end of the bed opposite the winch is attached a die holder preferably comprised of a stanchion having a clip plate disposed in parallel and spaced apart from the nether face of the stanchion substantially perpendicular the bed further preferably comprised of a slotted steel shim formed into a clip.

Oriented vertically, with the die at the bottom and the winch at top, there is no need for bench legs and the floor space required is minimized while locating the crank at a comfortable height for operation. Operated horizontally, the bed is simply placed upon a work bench or other suitably stable, horizontal surface of a convenient height. The longitudinally compact configuration of the inverted lateral link arm draw tongs yields a significant reduction in overall length in comparison with a conventional pair of tongs of equivalent capacity. Pulled by a belt wound by a manual winch, the complete device possesses a load capacity comparable to conventional chain driven horizontal benches and an available draw length exceeding the conventional apparatus with the same length bed with a construction which is inherently less expensive than a conventional bench.

BRIEF DESCRIPTION OF THE DRAWINGS

FIG. 1 is a plain elevational view taken from the top of a conventional pair of straight jaw spring biased draw tongs, ie. PRIOR ART.

FIG. 2 a plain elevational view taken from the front of a pair of draw tongs comprising preferred embodiment of the principles relating to the present invention.

FIG. 4 is a plain elevational view taken from the front of a drawing device illustrating a preferred embodiment of the principles relating to the present invention.

FIG. 5 is an isometric detail view taken of the draw die holder seen at the bottom of the device depicted in FIG. 4.

DETAILED DESCRIPTION OF THE PREFERRED EMBODIMENTS

Figure 3:
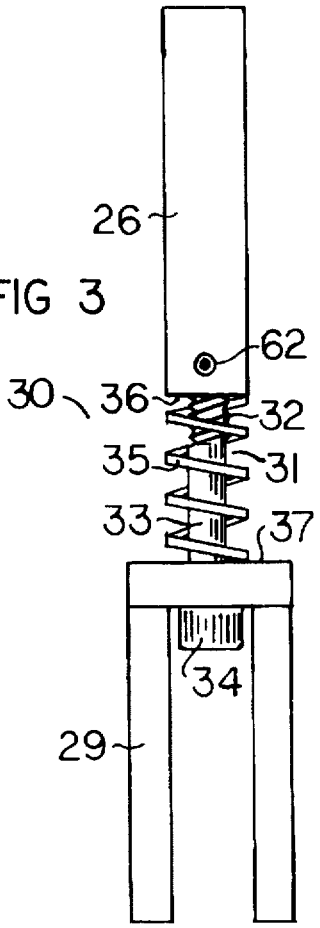
FIG. 3 a plain elevational view taken from the side of the stop bolt assembly seen in frontal view in FIG. 2 illustrating the components and working thereof.

FIG. 1 illustrates a conventional pair of draw tongs 10 with straight jaw arms 11 connected by a pivot 12 proximate the jaws 13. The ends 14 of the jaw arms 11 distal the jaws 13 each have a pin 15 with a hardened surface roller about it which is engaged by a wedge 17 which is integral to the draw block 16. This wedge 17 is loosely trapped at either side in an internal cavity of the jaw arms 11 which in practice is prone to momentary jamming. The spring 18 is held positively between the two jaw arms 11. The draw block 16 also has a hook 19 for engaging a chain in tension which action forces the wedge 17 against the roller pins 15 and distal ends 14 of the jaw arms 11 outward, closing the jaws 13.

The overall length of the tongs is considered to be the distance between the blunt end of the jaws 13 and the engaging surface of the hook 19 on the draw block 16, taken along the draft line. It is observed that this engaging surface is at a considerable distance along this draft line from the position of contact between the wedge 17 and the roller pins 15. This is necessary because the length of the wedge along the draft line is required in opening the tongs 10. This aspect is a commonplace with conventional straight jaw draw tongs. The draw block 16 and the hook 19 are components machined from steel plate and block, respectively, attached together.

With this construction, the total number of components is quite few: (2) jaw arms 11, (if cast), (2) roller pins 15, each secured with one snap ring, another pin secured on either side of the tongs by a snap ting to effect the pivot 12, (1) spring 18, (1) draw block 16 and one hook 19, only eight (8) major components. This relative simplicity is generally considered advantageous with regard to durability and ease of assembly. However, this approach relies upon massive construction in order to obtain a pair of tongs which, in effect, relies upon the rigidity of the tongs, particularly the jaw arms 11, to act as an effective stop against excessive load. This results in tongs 10 of the type depicted in FIG 1 which in a cast steel model weighs three pounds five ounces with an overall length of nine and one half inches.

FIG. 2 depicts a pair of draw tongs 20 in accordance with the principles relating to the present invention wherein a pair of jaw arms 21 are connected by a jaw pivot 22 proximate the jaws 23. Each jaw arm 21 further possesses at the distal end 24 a pivot 25 connecting the arm 21 with a lateral link arm 27. The two link arms 27 are also connected, as shown, to the draw block 26 by a central pivot 28. It is observed that the position of this central pivot 28 along the draft line is closer to the jaws 23 than the pivots 25 at the distal ends 24 of the jaw arms 21. These lateral link arms 27 are therefore further considered 'inverted', ie. having a negative inclination with respect to the direction of the tension. This angle is quite important because if it is allowed to approach perpendicularity with the draft line catastrophic failure would be likely. Therefore, a positive stop means is indicated. In FIG. 2 a stop bolt assembly 30 together with the front face of a stop bracket 29 is depicted in relation to the tongs 20.

As seen in FIG. 3, the stop bolt assembly 30 comprises a stop bolt 31 with its end 32 threaded into a tapped bore in the draw block bottom end 36. The bolt shaft 33 passes through a smooth bore through the stop bracket top end 37 and the bolt head 34 is trapped therein. A spring 35 about the stop bolt is in a state of compression between the bottom end 36 of the draw block 26 and the top end 37 of the stop bracket 29. This preferred mechanism provides three very important elements: (i) stopping the lateral link arms 27 from approaching perpendicularity with the draft line, (ii) doing so with an adjustable positive stop and (ii) biasing the jaws 23 shut in a rest position so no manual effort is required to keep the workpiece gripped while loading.

It is noted that the draw tongs 20 depicted in FIG. 2 possess jaw arms 21, jaws 23, lateral link arms 27 and a stop bracket 29 all having a substantially uniform thickness and of lesser dimensions than the conventional tongs 10 depicted in FIG. 1. These smaller dimensions allow the jaw arms 21 and lateral link arms 27 to flex under excessive load. Without a positive stop prohibiting further flexing, catastrophic failure would likely result. However, without the relatively slender physical dimensions which under excessive load allow flexing, the construction is necessarily more massive and of greater length overall.

The uniform thickness of the major components discussed above enables these components to be machined with relative ease from steel bar stock with only one piece of thicker stock required for the draw block 26. The jaw pivot 22, the central pivot 28 and the distal arm pivots 25, which are essentially identical, along with the stop bolt 31 and spring 35, are readily comprised of standard hardware. As with the jaw arms 11 of the conventional tongs 10, however, it is quite feasible to cast each jaw arm 21 and jaw 23 in a single piece and the stop bracket 29 as one piece. The draw block 26 in a machined construction as shown in FIGS. 2 & 3 is in one piece already but casting it also may yield some advantages, particularly if a more complex configuration such as depicted in FIG. 3*b* is utilized. With major components either machined from stock or cast, the mass of the draw tongs 20 is considerably reduced in comparison with conventional tongs 10. A pair of tongs in accordance with the principles relating to the present invention possessing a capacity comparable to conventional tongs weighs only one pound twelve ounces, nearly half as much as the prior art discussed above.

Furthermore, the overall length of the tongs 20 depicted in FIG. 2 and described herein as comprising one preferred embodiment of the principles relating to the present invention, at six and one half inches, is a full three inches shorter than the conventional tongs 10. This means that on the same draw bench or device the tongs 20 of the present invention will yield an additional three inches of capacity in the length of draw obtainable. Both the savings in weight and in length are owed to the use of inverted lateral link arms 27 which yield mechanical advantage in converting the tension applied to the draw block 26 into compression of the jaws 23. The use of inverted lateral link arms 27 also facilitates the shorter and more slender construction which, besides the savings in mass, largely ensures that the cost of the tongs 20 of the present invention will be less than that of the conventional tongs 10.

Figure 3A:
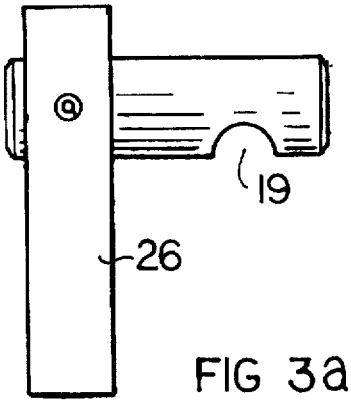
FIG. 3*a* is a plain elevational view taken from the side of an alternate draw block illustrating a hook for engaging a chain.
Figure 3B:
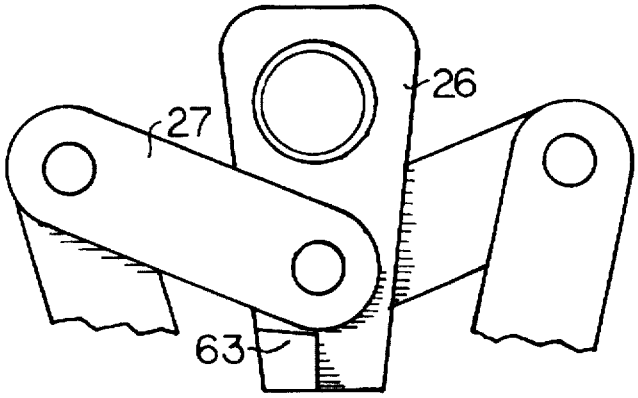
FIG. 3*b* is a plain elevational view taken from the front of an alternate draw block with an extended stop for the lateral link further cast as a single piece.

While the draw tongs 20 in accordance with the principles relating to the present invention depicted in FIG. 2 possesses a draw block 26 which possesses an eye 26*i* for attachment of a belt 45 looped through the same and as shown in FIG. 4, a hook 19 may be readily placed upon the draw block 26 as seen in FIG. 3*a*. This will permit the tongs 20 of the present invention to be utilized on conventional draw benches which use a chain for tensioning. It is expressly suggested that the tongs 20 of the present invention may constitute an economic alternative to replacement tongs 10 of a conventional sort for use on conventional draw benches. The savings in overall length of the tongs 20 will yield additional length in drawing, as mentioned above, and the comparatively lower mass yields greater ease in handling. Therefore cost is but one advantage perceived in a pair of tongs 20 in accordance with the principles relating to the present invention in comparison with a pair of conventional tongs 10.

FIG. 4 depicts a preferred embodiment of a complete drawing device in accordance with the principles relating to the present invention with a manual winch 40 at the top end of a vertically disposed bed 47. The winch 40 possesses a crank 41 which revolves a small gear 42 that drives a large gear 43 fixedly attached to a spool 44 upon which the belt 45 is wound in drawing. The belt 45 is preferably looped through the eye 26*i* of the drawing block 26 and attached to the same by stitching 46 as shown. The tongs 20 utilized are preferably of the type described in detail above. The hole 49 through the bed 47 seen in FIG. 4, together with another hole obscured by the belt 45 in the upper half of the device, facilitates mounting proximate a corner of a wall or other suitable substantially vertical surface having one side open to allow movement of the crank 41 behind the plane of the bed 47. At the bottom end of the bed 47 a die holder 50 is rigidly affixed. If horizontally disposed, the bed 47 is lain flush with and along an edge of an elevated stable horizontal surface such as a workbench or a table, with the crank 41 overhanging the edge to permit rotation of the same.

FIG. 5 depicts a preferred embodiment of the die holder 50 in accordance with the principles relating to the present invention. As clearly seen herein, a stanchion 51, preferably braced, is rigidly attached to the bed 47 by welding 57 or any other suitable means. The stanchion 51 presents a substantially flat nether face 52 perpendicular to the bed 47 facing away from the direction of the draft and further possessing an aperture 53 therethrough. A slotted shim 55 is formed into a clip with the use of a spacer 54 which exceeds somewhat the width of a die plate and disposes the slotted shim parallel to the nether face 52 of the stanchion 51. The slotted shim 55, formed into an appropriate clip shape, exerts pressure upon and holds steady a die plate placed flush with the nether flat face 52 of the stanchion 51. The slotted shim 55 and spacer 54 are, in the preferred embodiment depicted, attached in position to the stanchion 51 with a pair of bolts 56.

The entire device described above is readily constructed from relatively inexpensive components without difficult or extensive machining. A complete winch 40 of the type commonly used in hauling boats onto trailers may be bolted to the top of the bed 47 and the free end of the belt 45 may be looped through an eye 26*i* of the draw block 26 and securely attached by means of stitching 46, as shown. The preferred construction of the die holder 50 including recommended attachment by means of welding 57 is described above. The stanchion 51, including braces as shown in FIG. 5, is readily fabricated from steel plate, cast in a single piece or cut from angle stock. It is recommended that the bed 47 be comprised of a single length of formed metal. In a preferred embodiment, either a formed steel beam or an aluminum extrusion, with a basic channel cross section, is specified. Other materials, such as fiber reinforced resins, from fiberglass to composite materials, typically carbon fiber in epoxy, may be suitable. The main consideration is strength in resisting deformation under tension, ie. sufficient rigidity.

A device in accordance with the principles relating to the present invention as described above and depicted in the drawings attached constructed with a four foot length of channel steel with a nominal wall thickness of 0.150" and a nominal width of three inches, has proven to be of sufficient strength and rigidity for drawing annealed brass wire up to 10mm diameter. The tongs 20 depicted have an overall length of six and one half inches. The bar stock utilized for most of the components, including the jaw arms 21, jaws 23, link arms 27 and the stop bracket 29, has a nominal width of ¾" and nominal thickness of ¼". The rated capacity of the winch 40 is 600 lbs, that of the belt 45, 5000 lbs in shear.

The maximum length of draw on this device is thirty-eight inches, however, the total length of the bed is only four feet. The typical capacity in draw length available on the conventional benches described is four feet, however, the bed on these is six feet in total length. A device in accordance with the principles relating to the present invention possessing a bed of five feet length, a foot shorter than the conventional bench, will have essentially the same draw length. And the draw diameter capacity of 10 mm is comparable to a conventional chain driven draw bench. These capacities compare quite favorably with the capacities of the 'Quick Draw Wire Forming Machine' discussed above: 3mm diameter and twenty-five inches. Thus, the entire drawing device of the present invention achieves the capabilities of a conventional draw bench using conventional tongs with a construction which is inherently less expensive to manufacture.

The bed 47, comprised of a length of channel stock and lacking legs, is much less expensive than a conventional bench. The use of a standard winch 40 and a belt 45, as opposed to the manual or motorized winch and chain which is integral to a conventional bench, saves considerable expense. The die holder 50, constructed of steel plate and using a readily purchased slotted shim 55 is of minimal cost to manufacture compared with all other known devices. The tongs 20 of the present invention, owing to the mechanical advantage gained by the use of inverted link arms 27, realize a savings in weight, length and cost. In total, a complete drawing device in accordance with the principles relating to the present invention constructed as described in detail herein is expected to retail at less than half the cost of a conventional chain driven draw bench using conventional straight jaw tongs having a comparable capacity with regard to both draw diameter and available draw length. Another cost savings, in comparison with conventional drawbenches, is realized in shipping of the product. The conventional benches must be shipped by motor freight. A complete device in accordance with the principles relating to the present invention, as described herein with a four foot bed total length weighs only twenty-two pounds and may readily be shipped via standard mail services.

A few alternative constructions in accordance with the principles relating to the present invention have been mentioned. The draw block 26 might have a hook 19 rather than an eye **26*i* as appropriate to the means of supplying tension during the draw. Welding 57 has been recommended for rigid attachment of the die holder 50 to the bed 47 and bolts have been recommended in attachment of the winch 40 to the bed 47. Bolts might replace the welding and vice versa. Stitching 46 is a preferred means of securing a belt 45 looped through the eye 26*i* of the draw block 26. Many other means of attaching a belt 45 to the draw block 26 are readily imagined. Stitching 46 is recommended because it may be wound up upon the spool 44** and thus does not significantly reduce the length of draw available.

Most importantly, it is emphasized that the means of providing a positive stop to further travel of the draw block 26 and inverted lateral link arms 27 comprising a stop bolt 31 with a head 34 trapped in a stop bracket 29 further threaded into the draw block bottom end 36 also having a spring 35 about the stop bolt shaft 33 in compression between the draw block bottom 36 and the stop bracket top end 37 is considered the most elegant in providing the stop, which further is adjustable and also biases the jaws shut. However, many other means of effecting a positive stop are readily devised, which further may be adjustable and also provide spring means for biasing the jaws closed.

Given the basic structure of two straight, non-crossing, jaw arms 21 connected together by a jaw pivot 22, each arm further having a distal pivot 25 to one of two inverted lateral link arms 27 both centrally pivoted to the draw block 26 and assuming basic symmetry about the draft line, physics dictates that the central pivot 28 and the jaw pivot 22 both be along, and that the two distal pivots 25 define a line perpendicular to, the draft line while the tongs 20 are under tension. Therefore, an inextensible link between either pair of pivots effects a positive stop to further travel of the draw block 26 and inverted lateral link arms 27. This holds for a simple interpretation of the mechanics including the condition wherein the jaw arms 31 or the lateral link arms 27 or both are flexing but all other components are considered rigid in comparison.

Figure 6:
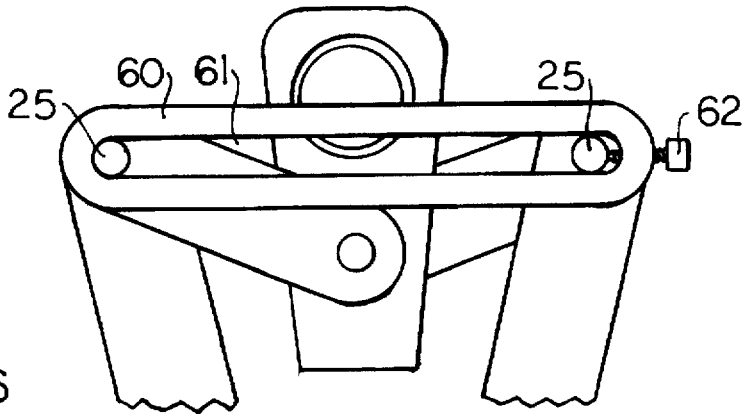
FIG. 6 is a partial plain elevational view taken from the front of a pair of draw tongs representing an embodiment of the principles relating to the present invention illustrating an alternative stop means.

The preferred means of providing this stop has been discussed extensively above with reference to FIGS. 2 & 3. It is considered that other types of inextensible links between the draw block 26 and the stop bracket 29 may be readily devised by one practiced in the art and that an inextensible link between these two components is functionally equivalent to an inextensible link between the central pivot 28 and the jaw pivot 22. The other case, having an inextensible link between the distal pivots 25, is depicted in FIG. 6 wherein a link 60 has a full length slot 61 through which extensions of the distal pivots 25 each are trapped. The slot 61 needs not be full length, but at least one end of the link 60 must be slotted a length toward the center to allow sufficient travel in opening the tongs 20. Also, as shown in FIG. 6, a set screw 62 threaded through one end of the link 60 as shown will readily provide adjustment to the stop if desired.

Next, it is considered that the stop need not comprise an inextensible link between either pair of pivots as discussed above. A rigid extension 63 of the draw block 26 perpendicular to the plane of the translation of force, as seen in FIG. **3*b*, will act as a stop to further movement of the lateral links 27. It is further suggested that a set screw threaded through this extension will also provide an adjustable stop if desired. An alternate manner of biasing the jaws 23 closed is given by the prior art depicted in FIG I which is problematic with a pair of tongs 20 as shown in FIG. 2 with the preferred stop means but is readily translated to an alternate pair of tongs 20 in accordance with the principles relating to the present invention using an inextensible link between the distal pivots 25 or a rigid extension 63 of the draw block 26 as a means of providing a stop to displacement of the lateral link arms 27** from approaching perpendicularity with the draft line.

It is emphasized that the above detailed description of the preferred embodiments in accordance with the principles relating to the present invention is intended to facilitate the ability of one practiced in the art to make and use the same. It is not intended to restrict in any manner the scope of the intellectual property secured by Letters Patent for which I hereby claim:

What is claimed is:

1. A pair of draw tongs intended for use on a straight line drawing device, said tongs comprising:

two straight jaw arms, two lateral link arms, a draw block, pivoted connections and a positive stop;

said two straight jaw arms each possessing two ends, one said end comprising jaws proximate a pivoted connection between said jaw arms, said other end being distal said jaws;

said two lateral link arms each possessing two ends, one said end having a central pivoted connection with said draw block, said other end possessing a distal pivoted connection with said distal end of one said jaw arm;

said central pivoted connection of both said lateral link arms with said draw block being disposed closer to said jaws along a draft line than both said distal pivoted connections of said lateral link arms with said distal jaw arm ends, said lateral link arms therefore being inverted with relation to the direction of the draft and acting outward upon said jaw arm distal ends with tension applied in the direction of the draft upon said draw block thereby closing said jaws;

said positive stop comprising means of restricting the outward displacement of said distal jaw arms effected by the tension applied upon said draw block and translated by said lateral link arms into an outward force upon said distal jaw arm ends thus prohibiting said lateral link arms from attaining perpendicularity with the draft line, said positive stop comprising means other than closing contact between said jaws.

2. The pair of draw tongs of claim 1 wherein said positive stop is comprised of at least one rigid extension of said draw block outward prohibiting one said lateral link arm from obtaining perpendicularity with the draft line.

3. The pair of draw tongs of claim 2 further including a spring in compression between said jaw arms biasing the jaws closed.

4. The pair of draw tongs of claim 1 wherein said positive stop is comprised of an inextensible link between said pivoted connections between the distal ends of said jaw arms with the distal ends of said lateral link arms.

5. The pair of draw tongs of claim 4 further possessing means of adjusting the restriction imposed by said positive stop upon the outward displacement of the distal ends of said jaw arms.

6. The pair of tongs of claim 1 wherein said pivoted connection between said jaw arms proximate the jaws is comprised of a single pivot.

7. The pair of draw tongs of claim 1 wherein said positive stop is comprised of an inextensible link between said central pivoted connection of said lateral link arms with said draw block and said pivoted connection between said jaw arms proximate the jaws.

8. The pair of draw tongs of claim 7 further having a stop bracket comprising a rigid member through which said pivoted connection between said jams arms passes and wherein said inextensible link between said central pivoted connection and said pivoted connection between said jaw arms is comprised of an inextensible link between said draw block and said stop bracket.

9. The pair of draw tongs of claim 8 wherein said inextensible link is comprised of a rigid shaft extending from said draw block through a bore in said stop bracket with a head at the end of the shaft distal the draw block trapped in said stop bracket.

10. The pair of draw tongs of claim 9 wherein said inextensible link is comprised of a bolt threaded into a tapped bore in said draw block with a shaft passing through a bore in said stop bracket with a head trapped in said stop bracket.

11. The draw tongs of claim 10 wherein a spring is disposed about the shaft of said bolt in compression between the draw block and the stop bracket thereby biasing the jaws shut.

* * * * *